US006656413B2

(12) United States Patent
Kay

(10) Patent No.: US 6,656,413 B2
(45) Date of Patent: Dec. 2, 2003

(54) METHOD AND APPARATUS FOR QUENCHING METAL WORKPIECES

(75) Inventor: John R. Kay, Niagara Falls (CA)

(73) Assignee: Can-Eng Furnaces Ltd, Niagara Falls (CA)

( * ) Notice: Subject to any disclaimer, the term of this patent is extended or adjusted under 35 U.S.C. 154(b) by 18 days.

(21) Appl. No.: 09/886,743

(22) Filed: Jun. 21, 2001

(65) Prior Publication Data

US 2002/0195753 A1 Dec. 26, 2002

(51) Int. Cl.[7] ..... C21B 7/10
(52) U.S. Cl. ..... 266/46; 266/114
(58) Field of Search ..... 266/113, 114, 266/46

(56) References Cited

U.S. PATENT DOCUMENTS

| | | | | |
|---|---|---|---|---|
| 4,305,574 A | * | 12/1981 | Amend | 266/114 |
| 4,444,556 A | * | 4/1984 | Andersson | 266/113 |
| 4,488,710 A | * | 12/1984 | Greenberger | 266/114 |
| 5,035,403 A | * | 7/1991 | Noville et al. | 266/114 |

* cited by examiner

*Primary Examiner*—Scott Kastler
(74) *Attorney, Agent, or Firm*—Simpson & Simpson, PLLC

(57) ABSTRACT

A method and apparatus for quenching an elongated metal workpiece, such as a pipe, bar, tube, or the like, involves, moving the elongated metal workpiece to be quenched longitudinally through at least one rotating spray unit having a plurality of outlets disposed in a substantially even arrangement over an inner surface thereof through which sprays of quenching fluid are directed at the metal workpiece.

18 Claims, 3 Drawing Sheets

METHOD AND APPARATUS FOR QUENCHING METAL WORKPIECES

BACKGROUND OF THE INVENTION

1. Field of the Invention

This invention relates to an improved method for quenching metal parts and, in particular, to a method for providing a uniform distribution of quenching medium around the part being quenched.

2. Background and Prior Art

The quenching of metal products, due to its great effect on the mechanical properties of the metal part being quenched, is one of the most critical steps in heat treating. The cooling rates during quenching determine temperature and stress distribution, phase transformations, microstructure, and deformation as well as residual stresses after quenching. The quenching of small metal parts or parts of simple geometry may be conveniently accomplished by immersion. However, the quenching of parts having a complex geometry or elongated metal parts, such as pipes, rods, tubes, bars, and the like, is more difficult and has been the subject of numerous developments over the last century. Attempts have been made to improve the manner in which such parts are quenched and to provide better control over distortion and cracking.

One of the more efficient methods for achieving low distortion and cracking during quenching is that of spray quenching. Various quenchants have been used for this purpose. Compared to other types of quenchants, such as oils, polymeric solutions, inert gases, etc., water is advantageous in that it is generally less expensive, readily available, and environmentally acceptable. However, water, like other evaporative quenchants, often produces a non-uniform quench, which may result in spotty hardness, distortion or cracking. The non-uniformity is mainly the result of a relatively unstable vapor blanket formed on the metal being quenched. It has been found that the use of a uniform and powerful spray system helps in reducing the non-uniformity problem caused by the vapor blanket formation. However, spraying alone, does not normally help in getting the metal part covered uniformly. Using current technology, the necessary level of uniformity may be achieved by rotating the part while being quenched. The rotational speed is normally dependent on the longitudinal feed of the part. Although this technique can efficiently complement the spraying effect and give good results for a wide range of applications, it has a significant disadvantage that sometimes limits its usefulness. The rotational speed of the metal part is limited to a certain maximum value due to its dependence on the longitudinal feed. The longitudinal feed is also limited by other process parameters, such as part size and geometry. This restricted rotational speed becomes the limiting factor for achieving high levels of uniformity and consequently high levels of quality.

Quenching apparatus described in the prior art includes a variety of devices for spraying quenching heat treated metal pipes, tubes, etc. U.S. Pat. No. 3,507,712 to Scott discloses a pipe-quenching apparatus wherein water spray from spray nozzles mounted on a manifold ring are directed to the pipe as the pipe travels lengthwise.

U.S. Pat. No. 3,675,908 to Amend discloses a pipe-quenching apparatus wherein quenching fluid is sprayed in a cone shaped spray against a longitudinally moving pipe as the pipe enters a sleeve wherein the quenching fluid richochets between the pipe and the inner surface of the sleeve to increase the quenching effect.

U.S. Pat. No. 4,305,574 to Amend discloses a pipe-quenching device wherein a high velocity spray of quenching fluid is directed to a longitudinally moving pipe at an acute angle to the direction of travel of the pipe.

U.S. Pat. No. 4,444,556 to Andersson discloses a cooling apparatus wherein an axially moving hot metal tube passes through a cylindrical cluster of individually repositionable spray nozzles.

SUMMARY OF THE INVENTION

It is an object of the present invention to provide an improved system for the quenching of elongated metal workpieces, such as pipes, bars, rods, tubes or the like.

It is a further object to provide a method and apparatus for quenching of elongated metal workpieces wherein the workpieces are moved axially through spinning spray quench headers.

It is a further object to provide a method and apparatus for the spray quenching of metal workpieces that will allow a more uniform distribution of quenching liquid around the metal workpiece than has been possible with the spray quenching methods of the prior art.

The above and other objects are achieved in accordance with the present invention which comprises a method and apparatus for quenching metal workpieces wherein a metal workpiece to be quenched is moved longitudinally through at least one rotating spray unit having a plurality of fluid outlets distributed over an inner surface thereof through which sprays of quenching fluid are directed at the metal workpiece. For most quenching operations it is preferred that the outlets through which the sprays of quenching fluid are directed are distributed in a substantially even pattern over the inner surface of the spray unit.

The present apparatus may be used in the spray quenching of workpieces of various sizes and shapes. Small workpieces of complex geometry, such as, gears or the like, may be quenched by placing in an open weave container, such as a basket and transporting through a rotating spray unit. The present rotatable spray apparatus is particularly useful for the quenching of elongated metal workpieces, such as pipes, bars, rods, tubes and the like. Thus, for example, a pipe or rod or the like may be quenched by spray quenching as it is continuously fed along the longitudinal axis of the rotating spray unit.

It is an advantage of the present system that the rotational speed of the spray unit may be varied to meet differing process requirements, since it is not dependent on the longitudinal feed of the workpiece through the spray unit. Furthermore, the system can handle workpieces of various size and geometry and still provide uniform quenching around the workpiece surface by adjusting the rotational speed of the spray unit to the required level.

Modular construction of the present apparatus allows convenient adaptation to varying production requirements or process changes. For example, additional spray units may be added to the initial configuration or other units may be conveniently removed or relocated. Where multiple spray units are employed, the rotational speed of each unit may be individually adjusted.

Furthermore, to achieve optimum uniformity of the spray quenching, the longitudinal feed rate may be adjusted independently. In addition, the metal workpiece itself may be rotated as it travels through the rotating spray units. Typically, the elongated metal workpiece, such as pipe, rod, etc. may be moved longitudinally on rollers and by appropriate adjustment of the rollers, may be simultaneously rotated.

DETAILED DESCRIPTION OF THE DRAWINGS AND PREFERRED EMBODIMENTS

Figure 1:
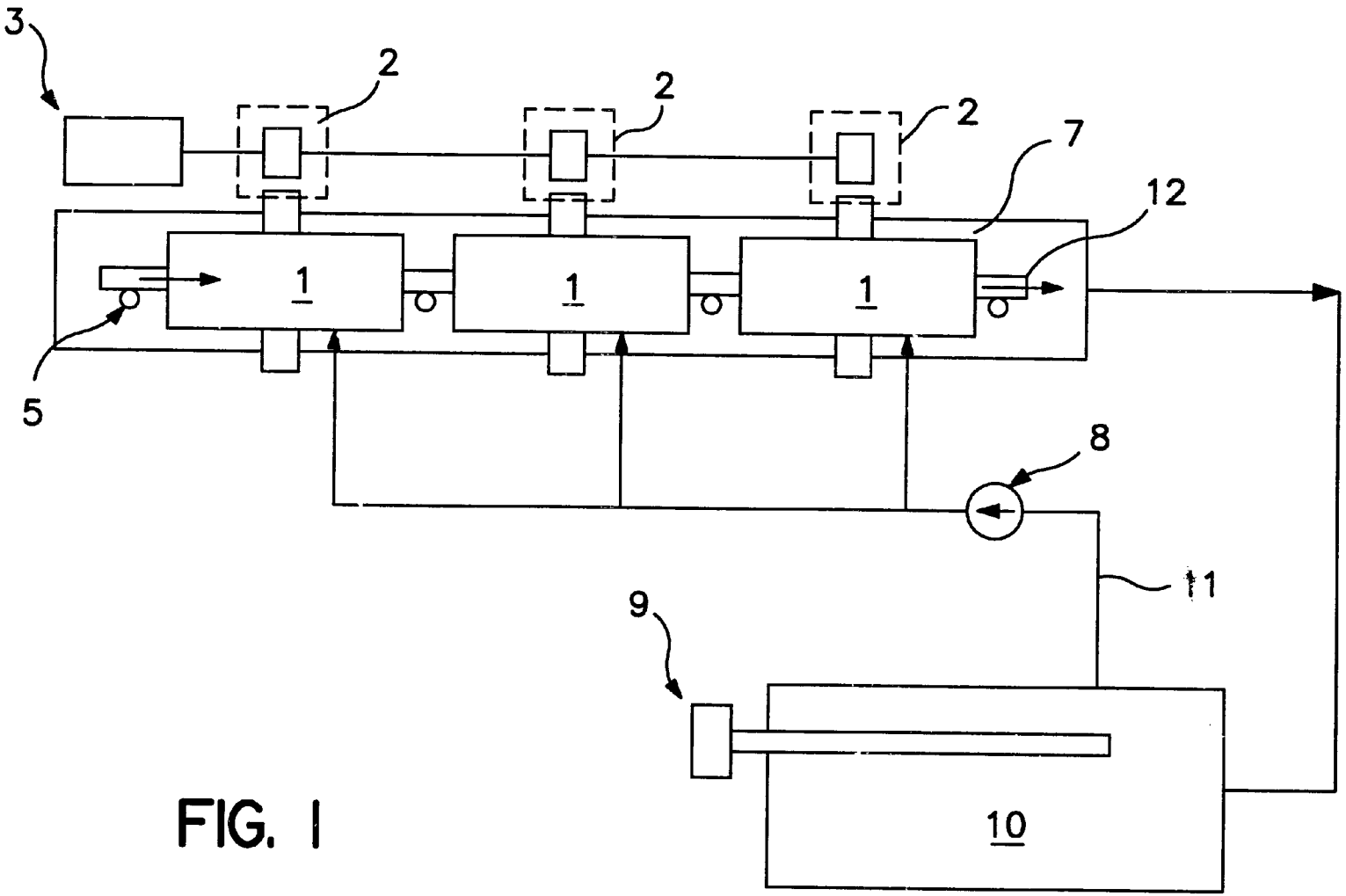
FIG. 1 is a schematic flow diagram of an embodiment of a rotating quench system of the present invention.

With reference to FIG. 1, there is shown an embodiment of a quenching system in accordance with the present invention wherein an elongated metal workpiece 12 to be quenched is moved longitudinally on rollers 5 through spray units 1 wherein quenching fluid is sprayed on the workpiece. The quenching fluid, such as water, oil, liquefied gas, such as liquefied nitrogen, or other, may be supplied to the spray units 1 from a quenchant source tank 10 through pipes 11 with the aid of one or more pumps 8. The temperature of the quenching fluid may be controlled, for example, by means of an immersion heater 9 in quenchant source tank 10. Furthermore, if desired, the temperature of the fluid may be varied in the different spray units 1, for example, through the use of heating or cooling units (not shown) on the quenchant pipeline 11. The rotational speed of the spray units 1 may be controlled, for example, with a variable speed motor 3 and a suitable motion transmission system 2. The rotational speed can be varied in the different spray units 1 by providing a separate variable drive at each unit. Modular construction of the quenching system allows the addition or removal of spray units 1 to meet various process requirements. Although the number of spray units may vary considerably, it has been found preferable to employ six to ten units. It is an advantage of the system that the rotational speed of the spray units 1, individually or collectively, may be adjusted independently of the longitudinal speed of the workpiece 12 through the spray units. After spraying on the workpiece, the quenchant fluid may be collected in collecting tank 7 and returned to quenchant tank 10 for subsequent reuse.

The flexibility of the present system, including the controllable, independent variations of the number and rotational speed of the spray units, the longitudinal speed of the workpiece, and temperature profile, allows convenient adaptation to varying production rates or process changes and renders the system extremely flexible in the handling of workpieces of various sizes and geometry.

Figure 2:
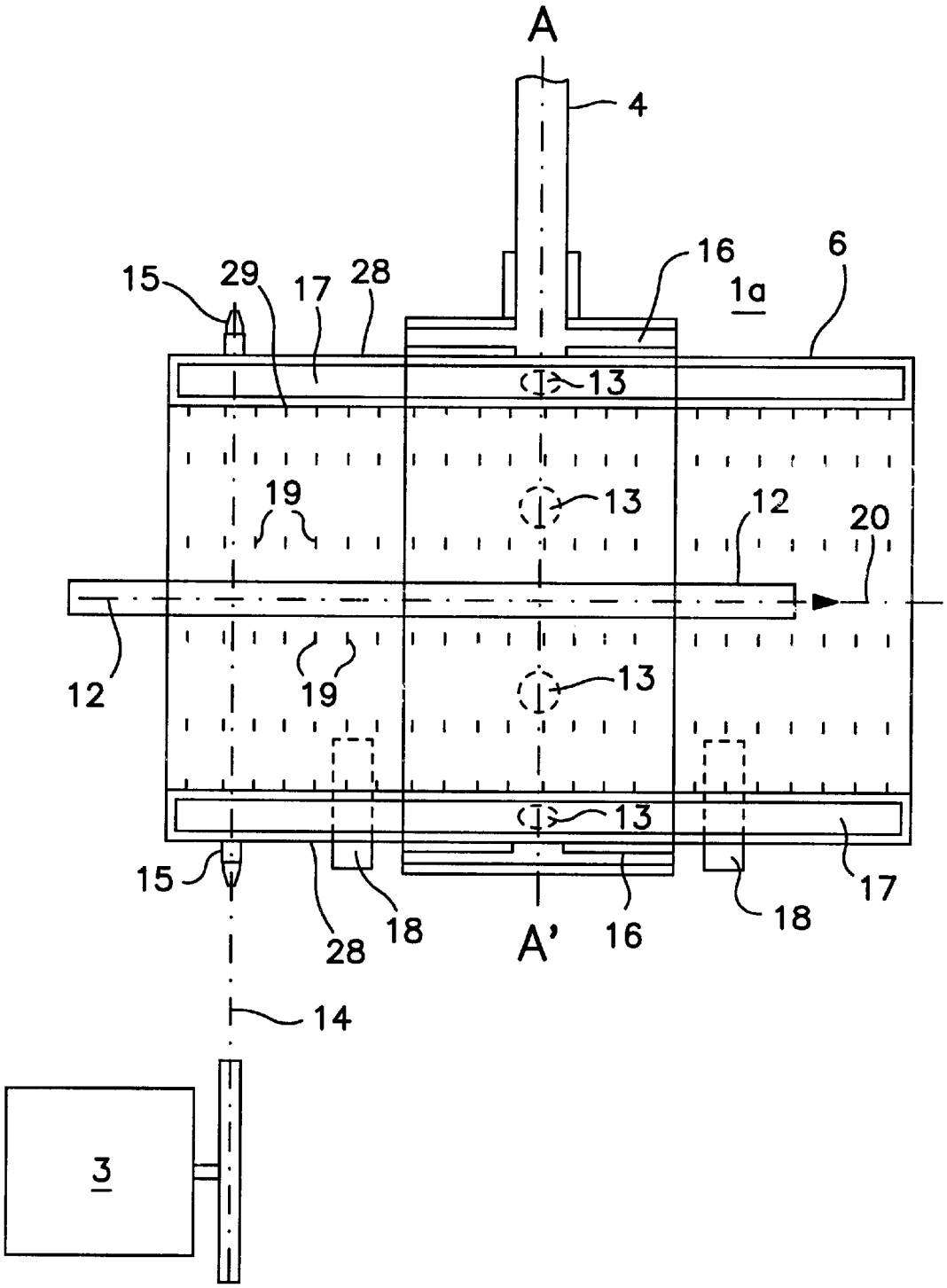
FIG. 2 is a side cross-sectional view of an embodiment of a rotating spray unit of the present invention.
Figure 3:
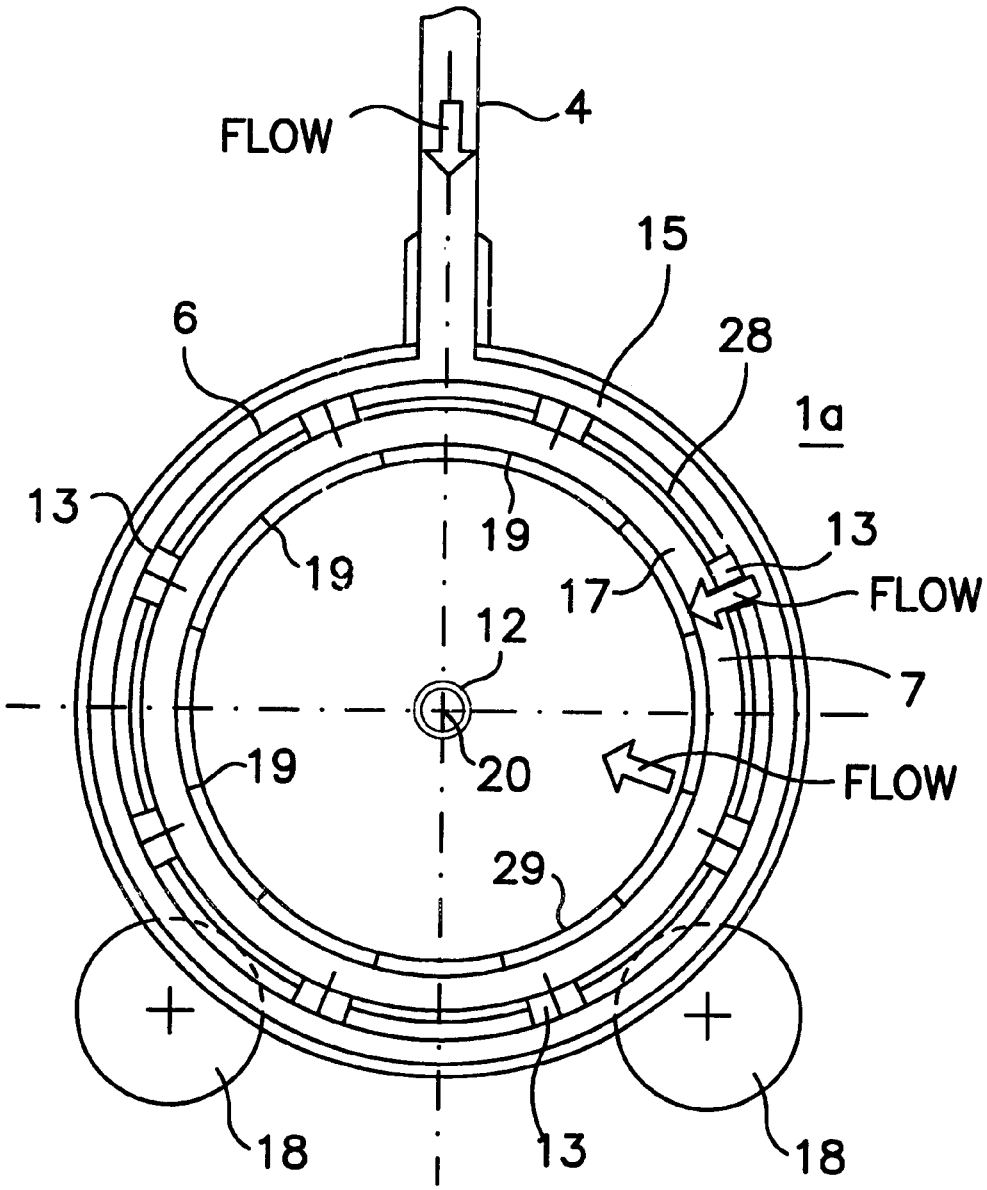
FIG. 3 is a front cross-sectional view of the spray unit of FIG. 2, taken along the line A–A'.

FIGS. 2 and 3, show details of an embodiment of a rotating spray unit 1*a* in accordance with the present invention wherein quenchant fluid is supplied under pressure through inlet pipe 4 to an outer stationary cylindrical supply chamber 16 surrounding a portion of rotatable cylinder unit 6. Cylinder unit 6 is rotatable on support rollers 18 in response to drive motor 3, connected to sprocket 15 by drive chain 14. Rotatable cylinder unit 6 includes an outer rotatable chamber 17 contained within concentric cylindrical walls, outer cylindrical wall 28 and inner cylindrical wall 29. As cylinder unit 6 rotates, driven by drive motor 3, a multiplicity of openings 13, distributed around outer cylindrical wall 28, allow the passage of quenchant fluid from supply chamber 16 into chamber 17. From chamber 17 the quenchant fluid flows through a multiplicity of spaced openings 19 in cylindrical wall 29 to form a multiplicity of rotating sprays directed toward the longitudinal axis 20 of cylinder unit 6 as the elongated workpiece 12 to be quenched, travels through the multiplicity of rotating sprays along longitudinal axis 20. The sprays may emanate directly from the openings 19 or, alternatively, nozzles (not shown) may be placed at each opening to provide a more controlled spray pattern and may be directional or positionable to direct the fluid as desired.

Although the invention has been described with reference to certain preferred embodiments, it will be appreciated that modifications and variations may be made without departing from the spirit and scope of the invention as defined in the accompanying claims.

What is claimed is:

1. A quenching spray apparatus for quenching a metal workpiece, comprising at least one rotatable spray unit having a central longitudinal axis and adapted for the positioning of said metal workpiece along said central longitudinal axis, said rotatable spray unit having a multiplicity of fluid outlets disposed over an inner surface thereof and directed to dispose streams of quenching fluid toward said central longitudinal axis.

2. A quenching spray apparatus according to claim 1 wherein said rotatable spray unit comprises an outer stationary quenchant supply chamber surrounding at least a portion of a rotatable cylinder, said rotatable cylinder comprising an outer cylindrical wall and an inner cylindrical wall concentrically positioned, and defining a quenchant spray chamber, said quenchant supply chamber being in periodic fluid communication with said quenchant spray chamber as said rotatable cylinder is rotated in response to a drive means.

3. A quenching spray apparatus according to claim 2 wherein said multiplicity of fluid outlets are distributed in a substantially even distribution on said inner cylindrical wall to provide a multiplicity of streams of quenchant fluid directed toward said longitudinal axis.

4. A quenching spray apparatus according to claim 3 additionally comprising a means for the longitudinal movement of said metal workpiece along said central longitudinal axis.

5. A quenching spray apparatus according to claim 3 comprising a single rotatable spray unit.

6. A quenching spray apparatus according to claim 3 comprising more than one rotatable spray unit assembled sequentially along said central longitudinal axis.

7. A quenching spray apparatus according to claim 3 wherein said drive means is a variable speed motor.

8. A quenching spray apparatus according to claim 4 wherein said apparatus is operatively arranged to quench an elongated metal workpiece.

9. A quenching spray apparatus according to claim 6 wherein rotational speed of each of said more than one cylindrical rotatable spray units is separately controllable.

10. A quenching spray apparatus according to claim 3 additionally comprising means for controlling the temperature of said quenchant fluid.

11. A quenching spray apparatus according to claim 6 wherein the temperature of said quenchant fluid in each of said more than one cylindrical rotatable spray units is separately controllable.

12. A quenching spray apparatus according to claim 3 additionally comprising means for collecting and re-circulating said quenchant fluid.

13. A quenching spray apparatus according to claim 12 wherein said apparatus is operatively arranged to quench said workpiece with a liquid.

14. A quenching spray apparatus according to claim 12 wherein said apparatus is operatively arranged to quench said workpiece with water.

15. A method for quenching a metal workpiece comprising positioning said metal workpiece within a surrounding rotating spray unit and subjecting said metal workpiece to a spray of quenchant fluid from a multiplicity of fluid outlets distributed on an inner surface of said rotating spray unit.

16. A method for quenching an elongated metal workpiece comprising moving said elongated metal workpiece longitudinally through at least one surrounding rotating spray unit along a central longitudinal axis thereof while said elongated metal workpiece is subjected to a spray of quenchant fluid from a multiplicity of fluid outlets distributed on an inner surface of said rotating spray unit.

17. A method according to claim 16 wherein said quenchant fluid is a liquid.

18. A method according to claim 17 wherein said liquid is water.

* * * * *